United States Patent [19]

Chen

[11] Patent Number: 4,979,220

[45] Date of Patent: Dec. 18, 1990

[54] INTEGRAL BODY SPEAKER WITH DETACHABLE TERMINAL PLATE

[75] Inventor: Ding B. Chen, Taipei, Taiwan

[73] Assignee: Audiovox International Limited, Taipei, Taiwan

[21] Appl. No.: 190,332

[22] Filed: May 5, 1988

[51] Int. Cl.[5] ..... H04R 9/06

[52] U.S. Cl. ..... 381/192

[58] Field of Search ..... 381/188, 205, 192, 194, 381/179, 201; 439/733, 734

[56] References Cited

U.S. PATENT DOCUMENTS

| | | | |
|---|---|---|---|
| 2,903,516 | 9/1959 | Biedermann et al. | 381/188 |
| 3,443,660 | 5/1969 | Virva et al. | 381/188 |
| 3,533,054 | 10/1970 | Spriggs et al. | 439/733 |
| 3,609,652 | 9/1971 | Sebastian | 381/194 |
| 4,061,890 | 12/1977 | Froeschle | 381/194 |
| 4,158,756 | 6/1979 | Keezer | 381/194 |
| 4,360,711 | 11/1982 | Steiner | 381/201 |
| 4,465,905 | 8/1984 | Nation | 381/194 |
| 4,520,237 | 5/1985 | Murakami | 381/194 |
| 4,566,178 | 1/1986 | Hecht | 381/194 |
| 4,590,332 | 5/1986 | Delbuck | 381/194 |
| 4,608,463 | 8/1986 | Burgess et al. | 381/194 |
| 4,692,942 | 9/1987 | Morgand | 381/188 |
| 4,703,508 | 10/1987 | Umezu | 381/188 |
| 4,737,992 | 4/1988 | Latham-Brown et al. | 381/194 |
| 4,752,962 | 6/1988 | Thiele et al. | 381/188 |

FOREIGN PATENT DOCUMENTS

| | | | |
|---|---|---|---|
| 2842738 | 4/1980 | Fed. Rep. of Germany | 381/188 |

*Primary Examiner*—Forester W. Isen

*Attorney, Agent, or Firm*—Zarley, McKee, Thomte, Voorhees & Sease

[57] ABSTRACT

A speaker having a core casing for enclosing a magnetic casing and a housing which form one integral piece. The integral piece accurately retains a magnetic plate and a magnetic core relative to the housing. An annular cavity is formed between the magnetic plate and the magnetic core for receiving a voice coil bobbin and cone assembly and allows the assembly to vibrate freely. The housing comprises an annular front face which has a terminal plate mounted on an outer edge thereof. A detachable terminal plate fits on the terminal plate mount core casing.

4 Claims, 4 Drawing Sheets

INTEGRAL BODY SPEAKER WITH DETACHABLE TERMINAL PLATE

BACKGROUND OF THE INVENTION

This invention relates to a speaker wherein the housing also forms a magnet casing and wherein the terminal plate is detachable.

In the past, speaker housings (a) were riveted to the metal plate of a ceramic magnet (b) by rivets (c), as shown in FIG. 4. However, riveting is relatively costly and complex. Moreover, in the past, the terminal plate was fixed to the housing, which made changing or repair of the terminal plate difficult.

It is the purpose of this present invention, therefore, to mitigate and/or obviate the above-mentioned drawbacks in the manner set forth in the detailed description of the preferred embodiment.

SUMMARY OF THE INVENTION

A primary objective of this invention is to provide a speaker wherein the housing also integrally forms a magnet casing.

Another objective of this invention is to provide such a speaker which has a detachable terminal plate.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
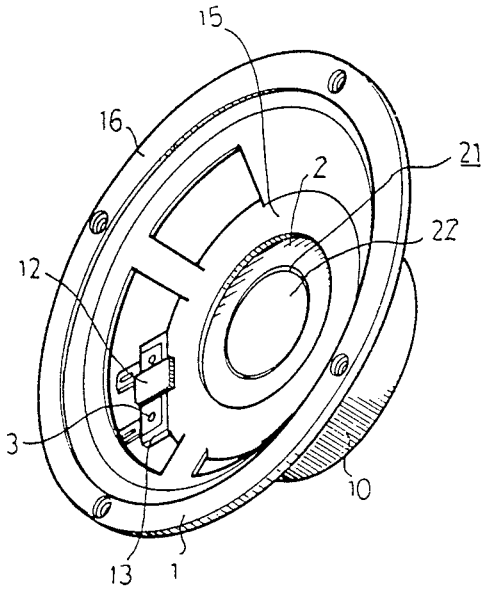
FIG. 1 is a perspective view of a speaker in accordance with the present invention.

Referring to FIG. 1, it can be seen that a speaker in accordance with the present invention comprises a housing 1 which forms an integral piece with a magnetic core casing 10 (usually annular or oval-shaped). The housing 1 also comprises an annular front face 15 on the front central area thereof which retains a magnetic plate 2 and a magnetic core 22 (also usually annular or oval-shaped) and which allows a voice coil bobbin and cone assembly 4 (shown in FIG. 3) to vibrate freely in an annular cavity 21 formed between the magnetic plate 2 and the magnet core 22. Furthermore, a mounting ring 16 extends from the front portion of the magnetic core casing 10 and the annular front face 15. Since the magnetic core casing 10 and the housing 1 form an integral piece, no rivets are required on the housing 1. The integral piece of the housing 1 and magnetic core casing 10 can be made by utilizing conventional injection molding techniques.

Figure 2:
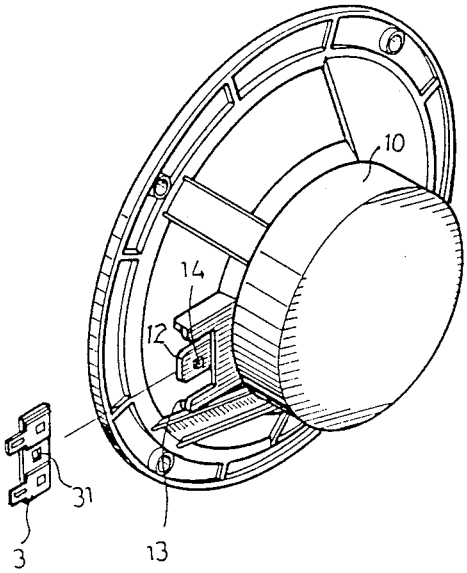
FIG. 2 is a perspective view of the rear side of the speaker of FIG. 1, showing the detachable terminal plate.

Further referring to FIG. 2, it can be seen that a terminal plate mount 13 projects from the outer annular surface of the magnetic core casing 10. The terminal plate mount 13 includes two rails and a retainer arm 12 which is positioned between the rails so that a terminal plate 3 is slidably attachable thereon. The retainer arm 12 also has a protuberance 14 thereon for engaging with a hole 31 which is located at the center of the terminal plate 3, thereby securing the terminal plate 3 on the retainer arm 12. The above arrangement which allows the terminal plate 3 to be interchangeable for easy repair or adjustment concerning the wires connected thereto is known in the art and does not play a part in the present invention.

Figure 3:
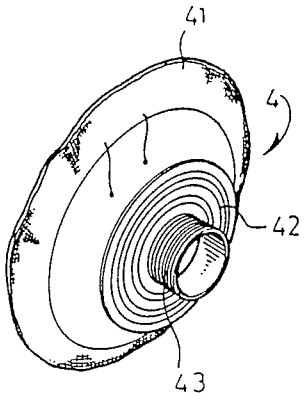
FIG. 3 is a perspective view of an inner cone in accordance with the present invention.
Figure 4:
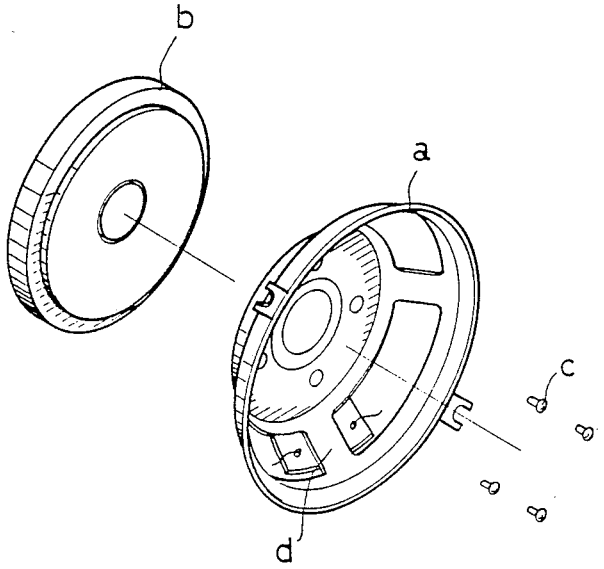
FIG. 4 PRIOR ART
FIG. 4 is a prior art exploded view showing the connection of a conventional housing and ceramic magnet.

Referring to FIG. 3, the voice coil bobbin and cone assembly 4 has a flange portion 41, with a spider 42 and a voice coil 43 mounted on about a central portion of the assembly. When the voice coil bobbin and cone assembly 4 is mounted on the housing 1, the spider 42 engages the magnetic plate 2 and the flange portion 41 engages the mounting ring 16, respectively.

Because the housing 1 and its inherent parts (i.e. the magnetic core casing 10, annular front face 15, and the mounting ring 16) all form one integral piece a speaker in accordance with the present invention is much lighter and much more durable than a conventional speaker.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A speaker comprising a housing (1) and a magnetic core casing (10), said housing (1) also comprising an annular front face (15) which retains both a magnetic plate (2) and a magnetic core (22), a voice coil bobbin and cone assembly (4) being insertable in an annular cavity (21) formed between the magnetic plate (2) and the magnetic core (22), a terminal plate mount (13) being formed on one side of said annular front face (15) for detachably receiving a terminal plate (3), said speaker being characterized in that the magnetic core casing (10) and the housing (1) are formed as a single unit by injection molding.

2. The speaker of claim 1 wherein the housing and magnetic core are formed of non-magnetic material.

3. A speaker comprising:

a unitary piece housing with a front face, a mounting ring and a magnetic core casing;

a magnetic plate and a magnetic core retained in the housing so as to form a cavity between the plate and core;

a voice coil bobbin and a cone assembly insertable in the cavity formed between the magnetic plate and the magnetic core; and a terminal plate detachably received on the housing.

4. The speaker of claim 3 wherein the housing is formed of plastic material.

* * * * *